US010222168B2

(12) United States Patent
Liao

(10) Patent No.: US 10,222,168 B2
(45) Date of Patent: Mar. 5, 2019

(54) TRAJECTORY ADJUSTMENT STRUCTURE OF GUN

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 0 days.

(21) Appl. No.: 15/989,154

(22) Filed: May 24, 2018

(65) Prior Publication Data

US 2019/0011217 A1 Jan. 10, 2019

(30) Foreign Application Priority Data

Jul. 7, 2017 (TW) ..... 106210044 U

(51) Int. Cl.
*F41B 11/00* (2013.01)
*F41B 11/70* (2013.01)
*F41B 11/89* (2013.01)

(52) U.S. Cl.
CPC ..... *F41B 11/70* (2013.01); *F41B 11/89* (2013.01)

(58) Field of Classification Search
CPC ..... F41B 11/00; F41B 11/70; F41B 11/89
See application file for complete search history.

(56) References Cited

U.S. PATENT DOCUMENTS

| | | | | |
|---|---|---|---|---|
| 5,450,838 A * | 9/1995 | Nakahigashi | F41B 11/00 | 124/56 |
| 5,655,510 A * | 8/1997 | Kunimoto | F41B 11/00 | 124/73 |
| 7,451,756 B2 * | 11/2008 | Tippmann, Jr. | F41A 21/00 | 124/74 |
| 7,603,998 B2 * | 10/2009 | Finstad | F41B 11/00 | 124/73 |
| 7,775,200 B2 * | 8/2010 | Anderson | F41B 11/00 | 124/83 |
| 2014/0007857 A1 * | 1/2014 | Schlosser | F41A 21/04 | 124/81 |

* cited by examiner

*Primary Examiner* — John Ricci
(74) *Attorney, Agent, or Firm* — Leong C. Lei

(57) ABSTRACT

A structure is mounted in a gun barrel and includes an adjustment assembly arranged at a front end of the gun barrel, a connection tube arranged in the gun barrel in abutting engagement with the adjustment assembly to be driven by the adjustment assembly for movement, a plurality of thread sections formed on the adjustment assembly and in threading engagement with the gun barrel for fine adjustment of the adjustment assembly, at least one transmission sleeve arranged at one end of the connection tube that is distant from the adjustment assembly, and a press-down member arranged at one side of the transmission sleeve to be abutted on by the transmission sleeve for pressing inwardly of the gun barrel.

10 Claims, 10 Drawing Sheets

TRAJECTORY ADJUSTMENT STRUCTURE OF GUN

TECHNICAL FIELD OF THE INVENTION

The present invention relates generally to a combination of a trajectory adjustment structure with a gun barrel to provide a trajectory adjustment structure that allows for stable and precise adjustment of a hop-up force applied to a projectile.

DESCRIPTION OF THE PRIOR ART

To allow a projectile of toy gun to maintain stable flying after being driven out of a barrel by pressurized gas, it is common to apply a hop-up force to the projectile.

A conventional hop-up adjustment mechanism is mounted outside the gun barrel and is fixed at a rear end part of the gun barrel. When it comes the need to replace the gun barrel, the hop-up adjustment mechanism must be removed first before the replacement can be conducted. It may occasionally occur that the replacement of gun barrel cannot be correctly carried out due to difference of design. Further, the conventional hop-up adjustment mechanism involves an adjustment means that is rough and adjustment is often conducted with a pin or a rotary wheel such that each step of adjustment involves a significant change of the hop-up force, making it hard to control the precision of adjustment of a trajectory.

In consideration of the precision of trajectory, a solution is provided for fine adjustment of the degree of hop-up of a projectile through depth of a downward stroke of a steel bead or other projection. Since this involves a fine adjustment operation with high precision, correction of trajectory may be conducted between successive shots and it is necessary to eliminate manual factors that cause instability, such as improving stability of holding gun and minimizing adjustment operation. However, the operation of adjustment would need sacrificing one hand for not holding the gun by moving the hand to the rear end of the gun barrel where the hop-up adjustment mechanism is located to conduct the adjustment. This would cause wobbling of the gun, and thus losing the significance of fine adjustment for trajectory.

SUMMARY OF THE INVENTION

The primary objective of the present invention is to provide an adjustment assembly that allows for precise adjustment through an arrangement of thread sections in order to achieve the purpose of fine adjustment of a hop-up force to thereby help improve correction of trajectory and also allows a trajectory adjustment mechanism to be mounted inside a gun barrel to allow for easy replacement of the gun barrel, and also to help improve operation stability of adjustment through direct operation of the adjustment assembly that is mounted at a front end of the gun barrel.

To achieve the above objective, the present invention is mountable in a gun barrel and has a main structure that comprises: an adjustment assembly arranged at a front end of the gun barrel. The gun barrel is provided therein with a connection tube in abutting engagement with the adjustment assembly and is movable as being driven by the adjustment assembly. The adjustment assembly is formed thereon with a plurality of thread sections that are in threading engagement with the gun barrel for a fine adjustment operation of the adjustment assembly. The connection tube is provided, on one end thereof that is distant from the adjustment assembly, with at least one transmission sleeve. The transmission sleeve is provided, on one side thereof, with a press-down member, which is in abutting engagement with the transmission sleeve for being pressed inwardly of the gun barrel. When a user attempts to adjust a trajectory by using the present invention, it only needs to simply rotate the adjustment assembly provided at the front end of the gun barrel so that wobbling of the gun during the operation of adjustment could be avoided. In addition, due to an effect provided by the thread sections, a depth of the connection tube could be continuously changed as being slowly pushed such that the transmission sleeve arranged at an opposite end of the connection tube could slowly change a position of abutting engagement thereof with the press-down member to cause the press-down member to gradually press inwardly of the gun barrel to set an upper side of an inside wall of the gun barrel in a concave configuration that could provide a frictional force to a top of a BB bullet moving through the gun barrel so as to apply a hop-up or lifting force to the BB bullet, imposing a force of moving upward after being shot. Through a fine adjustment operation conducted with the adjustment assembly, a trajectory of the BB bullet could be changed in a precise manner. Due to the present invention being directly coupled in the gun barrel, replacement of the gun barrel is made convenient.

A such, in view of the conventional measure for adjustment of a trajectory of a toy gun being rough and inaccurate so that it is hard to provide precise control of the trajectory, the adjustment operation may readily cause wobbling of the gun, and the adjustment structure is such that the replacement of the gun barrel is difficult, the present invention provides a solution that overcomes such problems and achieves an advantage of improving utilization thereof.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
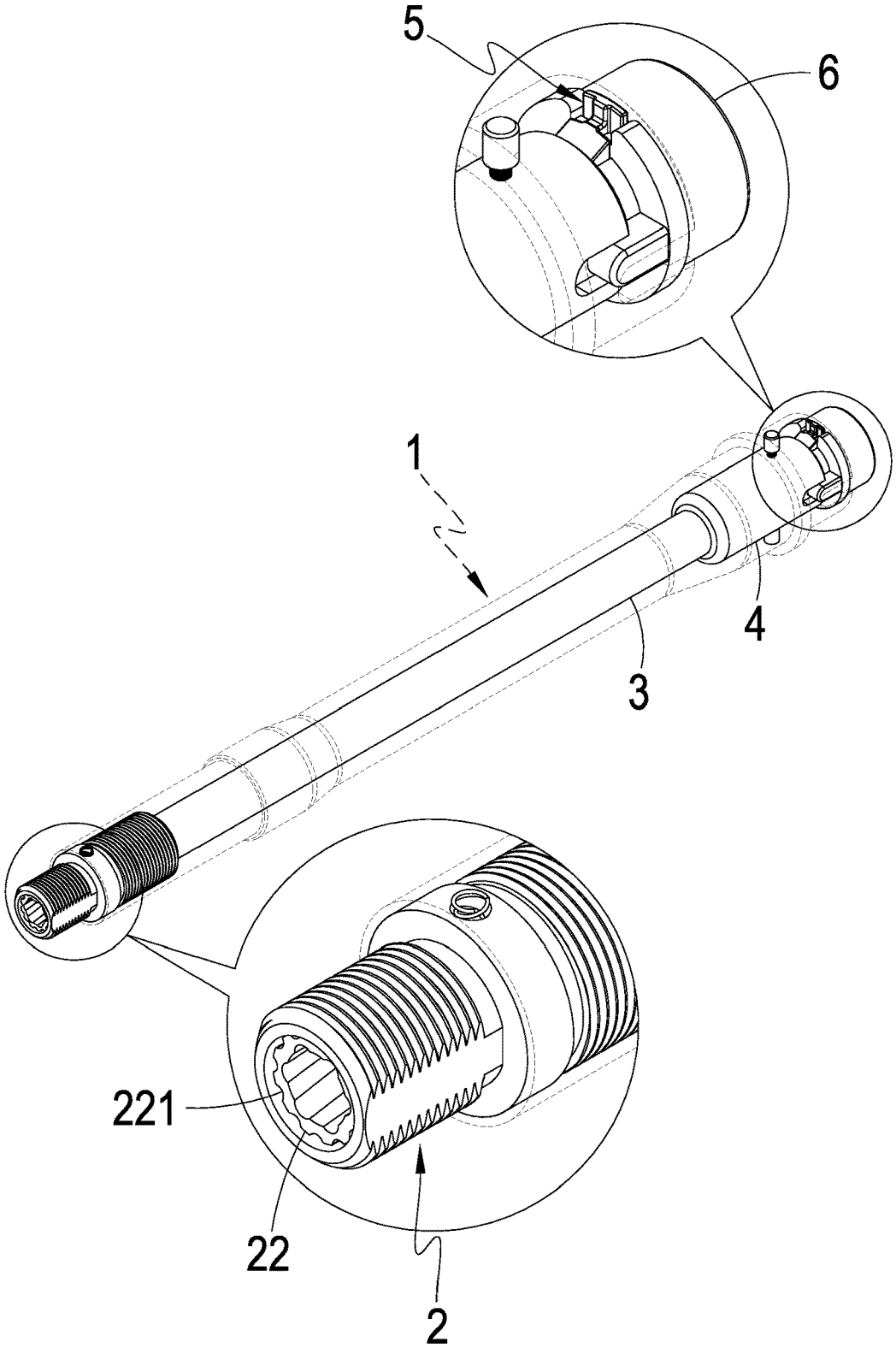
FIG. 1 is a perspective view showing a preferred embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1-4, the present invention is mountable in mountable in a gun barrel 1 and the gun barrel 1 comprises an external barrel member 11, an internal barrel member 12 arranged in the external barrel member 11 for a BB bullet to move therein, and at least one movement space 13 formed between the external barrel member 11 and the internal barrel member 12. A main structure of the present invention comprises the following:

an adjustment assembly 2, which is mounted to a front end of the gun barrel 1, wherein the adjustment assembly 2 comprises an internal adjustment member 22 for driving the connection tube 3 that will be described below to move and an external adjustment member 14 is provided, as being screwed, between the external barrel member 11 and the internal adjustment member 22;

a plurality of positioning grooves 221 formed in an outside circumferential wall of the internal adjustment member 22;

at least one positioning projection 142 provided on the external adjustment member 14;

at least one elastic element 143 having two ends respectively supported on and in engagement with the positioning projection 142 and an inside wall of the gun barrel 1;

a connection tube 3 arranged in the gun barrel 1 and abutting the adjustment assembly 2 to be driven by the adjustment assembly 2 to move;

a plurality of thread sections 21 formed on the adjustment assembly 2 and screwed to the gun barrel 1 for adjustment of the adjustment assembly 2 within a small range;

a plurality of internal thread sections 141 formed on an inside wall of the external adjustment member 14 to mate and couple with the thread sections 21;

at least one transmission sleeve 4 arranged at one end of the connection tube 3 that is distant from the adjustment assembly 2, wherein the transmission sleeve 4 comprises at least one abutting section 41 to abut a press-down member 5 that will be described below and at least one constraint section 42 that encloses the internal barrel member 12 and in engagement with an inside wall of the external barrel member 11 in order to allow the transmission sleeve 4 to move stably in a horizontal direction;

a returning element 43 arranged in the movement space 13 and is coupled to the transmission sleeve 4 to cause the transmission sleeve 4 to move in a direction toward the connection tube 3;

a press-down member 5 arranged at one side of the transmission sleeve 4 and abutted on by the transmission sleeve 4 to press inwardly of the gun barrel 1;

a slope section 51 formed on one side of the press-down member 5 that is adjacent to the transmission sleeve 4 to cause a change of an inclination angle of the press-down member 5 with variation of an abutting position thereof with the transmission sleeve 4;

a first curved surface section 52 formed on one side of the press-down member 5 that is opposite to the slope section 51 to provide abutting engagement, through a surface contact, with a BB bullet passing therethrough; and a fixing assembly 6 arranged at a rear end of the gun barrel 1 to fix the transmission sleeve 4 and the press-down member 5 so as to allow the gun barrel 1, the adjustment assembly 2, and the connection tube 3 to detachably couple to a gun.

The internal barrel member 12 comprises a notch section 121, and the internal barrel member 12 is provided with a flexible tube 15. The flexible tube 15 comprises a second curved surface section 151 formed at one side thereof corresponding to the notch section 121 and is abutted on by the press-down member 5 to provide abutting engagement, through a surface contact, with a BB bullet passing therethrough.

As shown in FIGS. 1-10, the main structure of the present invention is mounted inside the gun barrel 1 to facilitate replacement of the gun barrel 1 by the user. The user, when attempting to made an adjustment of the trajectory of BB bullets, may directly rotate the adjustment assembly 2 to abut on the connection tube 3 so as to drive the transmission sleeve 4 to move therewith, thereby making the press-down member 5 pressing inwardly of the gun barrel 1, to achieve the purpose of adjusting a hop-up force.

Figure 5:
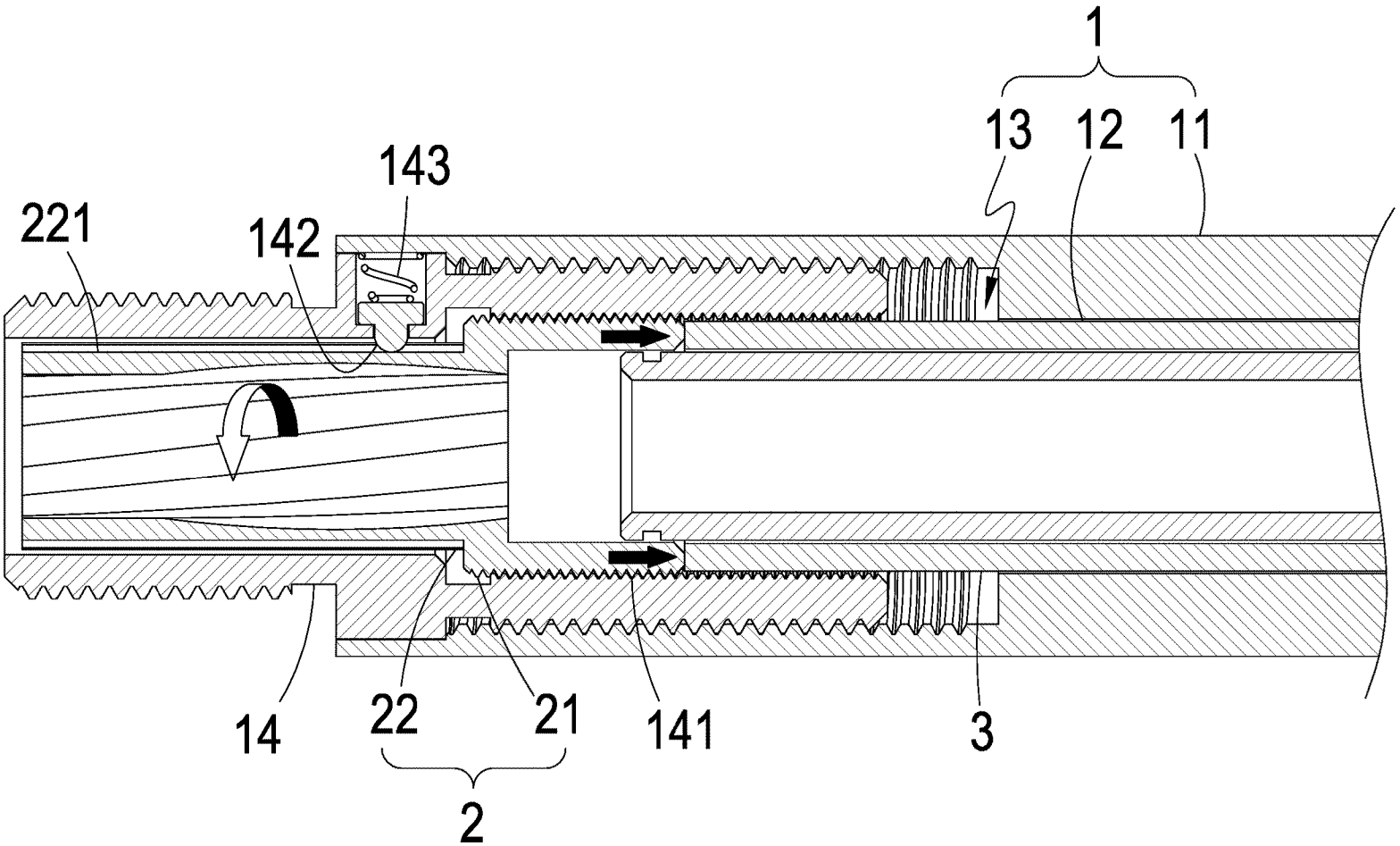
FIG. 5 is a schematic view demonstrating adjustment conducted with the preferred embodiment of the present invention.
Figure 6:
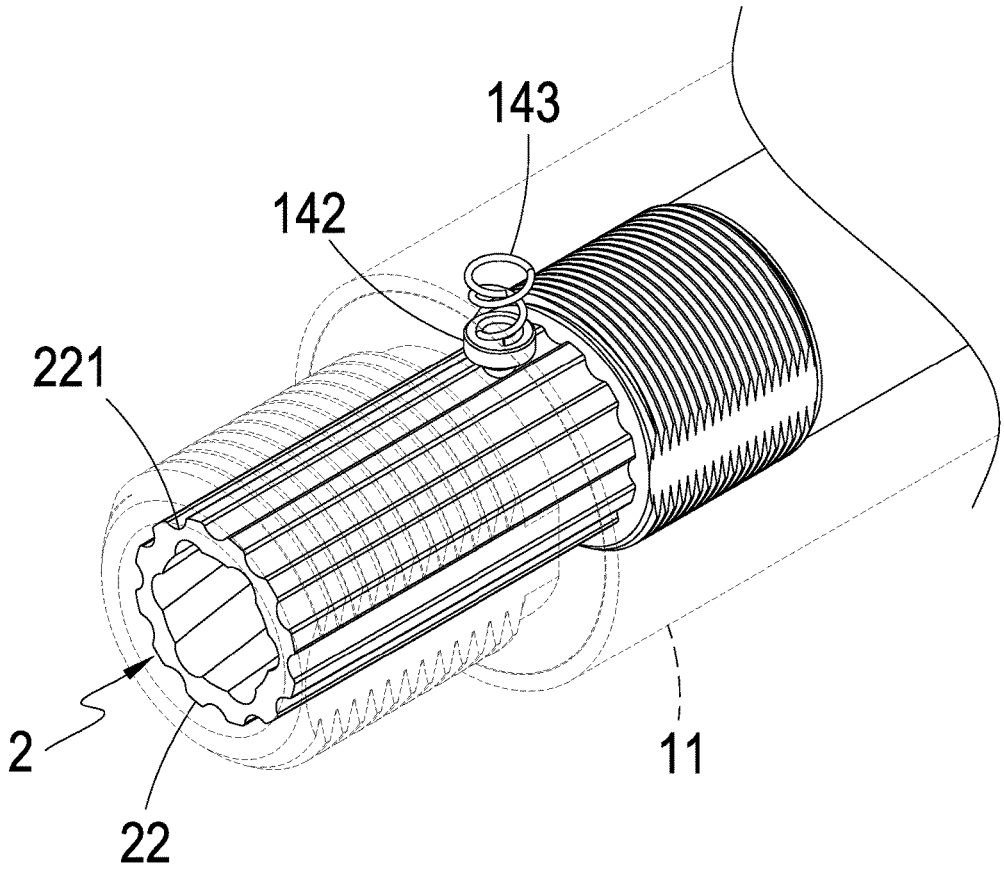
FIG. 6 is another schematic view demonstrating adjustment conducted with the preferred embodiment of the present invention.
Figure 7:
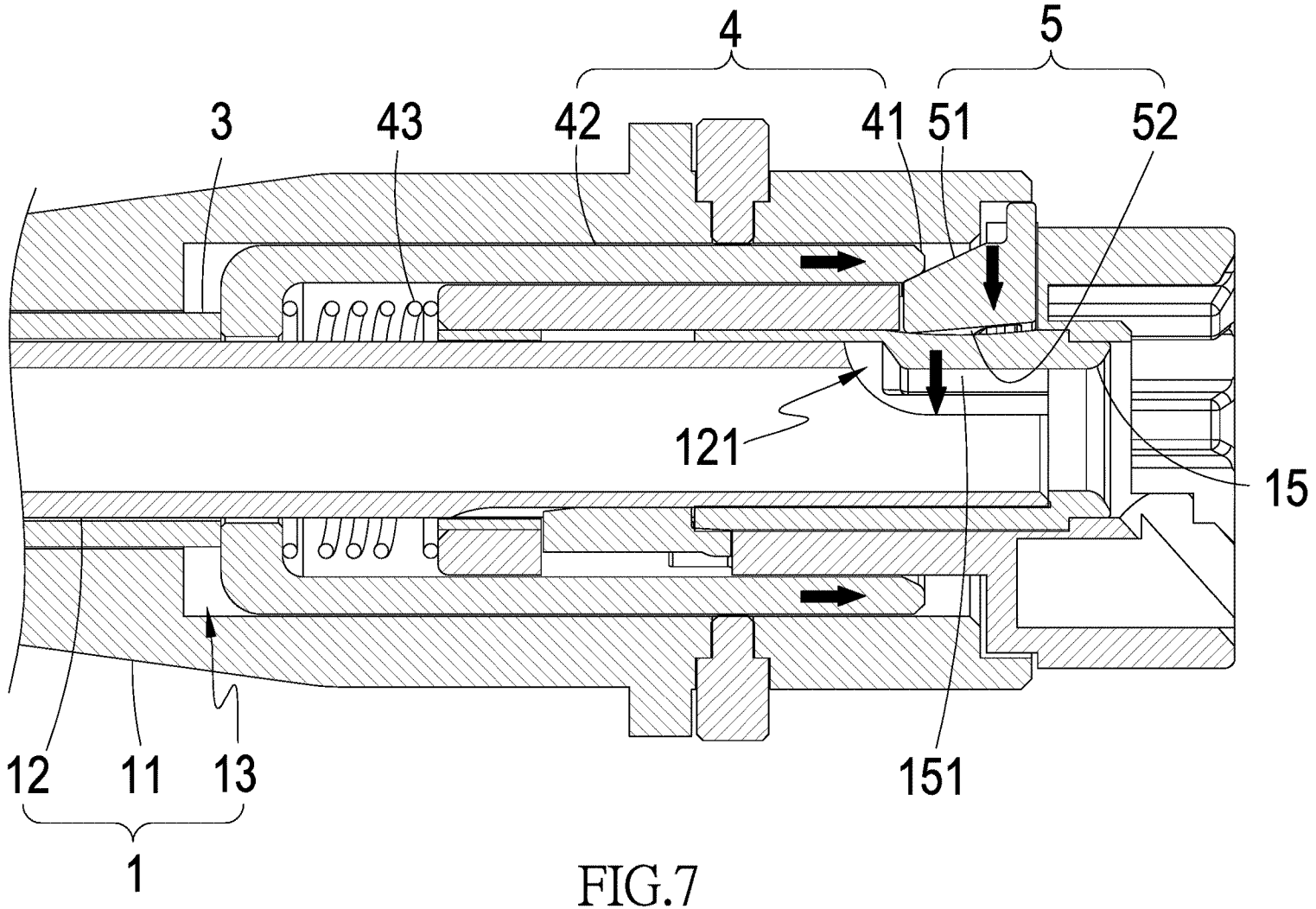
FIG. 7 is a schematic view demonstrating transmission conducted with the preferred embodiment of the present invention.

In an actual operation, as shown in FIG. 5, since the external adjustment member 14 is fixed in the external barrel member 11, rotation of the internal adjustment member 22 of the adjustment assembly 2 could, through relative displacement between the internal thread sections 141 and the thread sections 21, make the internal adjustment member 22 to move along the inside wall of the external adjustment member 14 to push against the connection tube 3. The thread sections 21 are arranged to have a small pitch so that fine adjustment of high precision may be conducted as being operated by the user. Further, as shown in FIG. 6, the positioning grooves 221 of the internal adjustment member 22 are used in combination with movement of the positioning projection 142 and the elastic element 143 to achieve positioning for the adjustment operation of the adjustment assembly 2. In the example, the positioning grooves 221 are arranged in a manner of being uniformly or equally angularly spacing around the outside circumferential wall of the internal adjustment member 22 at an interval of 30 degrees so that for each full turn that the user rotate the adjustment assembly 2, an effect of positioning or indexing 12 positions may be provided. Next, as being pushed by the adjustment assembly 2, the connection tube 3 that encloses outside the internal barrel member 12 is driven to have an opposite end thereof to push, simultaneously or synchronously, the transmission sleeve 4 in a rearward direction (as shown in FIG. 7). When the transmission sleeve 4 is so driven to move, the constraint section 42 is in contact engagement with the inside wall of the external barrel member 11 in order to maintain a stable horizontal movement within the movement space 13. As such, a force that is applied by the abutting section 41 to the press-down member 5 could be increased continuously and steadily.

Figure 8:
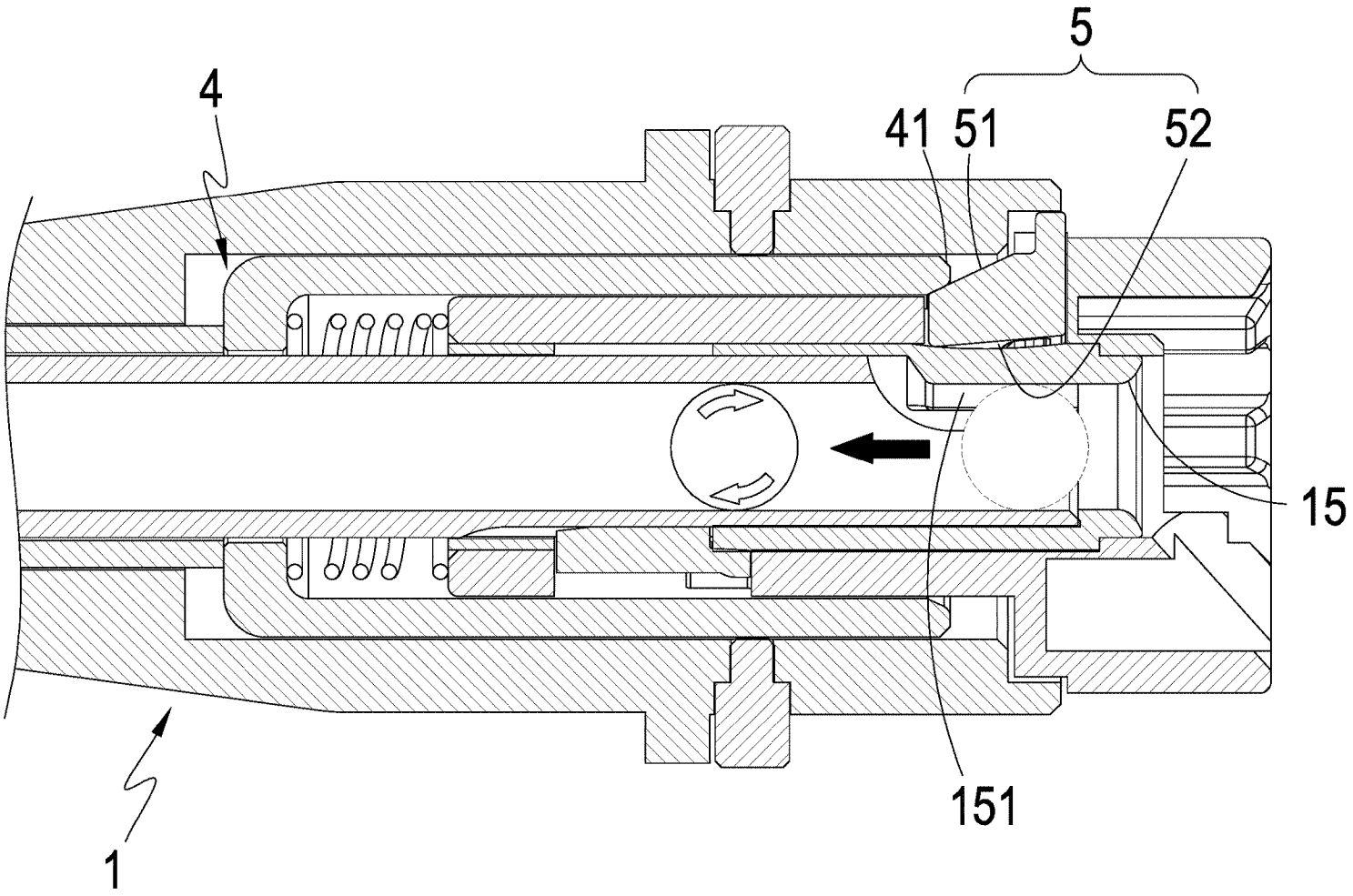
FIG. 8 is a schematic view demonstrating pressing conducted with the preferred embodiment of the present invention.

Further, as shown in FIGS. 7-8, during the movement of the transmission sleeve 4, the position that the abutting section 41 is set in engagement with or contacts the slope section 51 is continuously varied. The variation of such a position makes the press-down member 5 change the downward inclination angle thereof to as to press down in a direction toward deep interior of the gun barrel 1. Due to the first curved surface section 52 formed on the bottom or lower side of the press-down member 5, force can be uniformly applied to the flexible tube 15 arranged on the internal barrel member 12. Further, the flexible tube 15 is provided on an inner side thereof with the second curved surface section 151, so that a BB bullet passing through the notch section 121 would be subjected to frictional engagement with the second curved surface section 151 to generate a hop-up force. (Alternatively, the arrangement of the flexible tube 15 may be omitted and the first curved surface section 52 of the press-down member 5 may take the place thereof to provide such an operation.) Further, due to the curvature of the second curved surface section 151 being set to match an outer contour of a BB bullet, the frictional engagement thereof with the BB bullet is achieved though surface contact therebetween. This is different from the prior art in which contact is only made in the form of point contact, and could be of a significant stabilized hop-up effect and reduce potential risk of sideway spinning.

Figure 2:
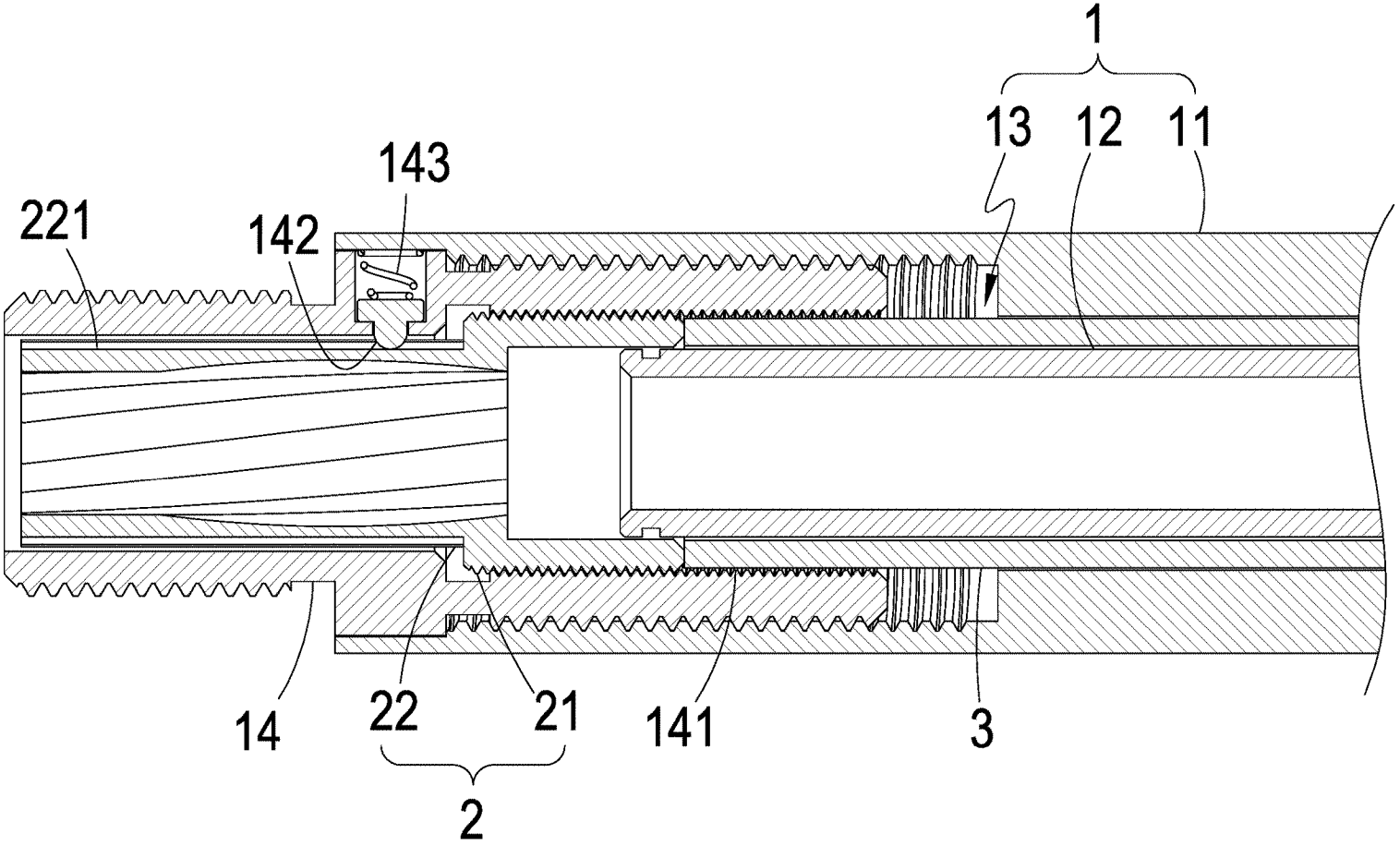
FIG. 2 is a cross-sectional view showing a front end part of a gun barrel of the present invention.
Figure 3:
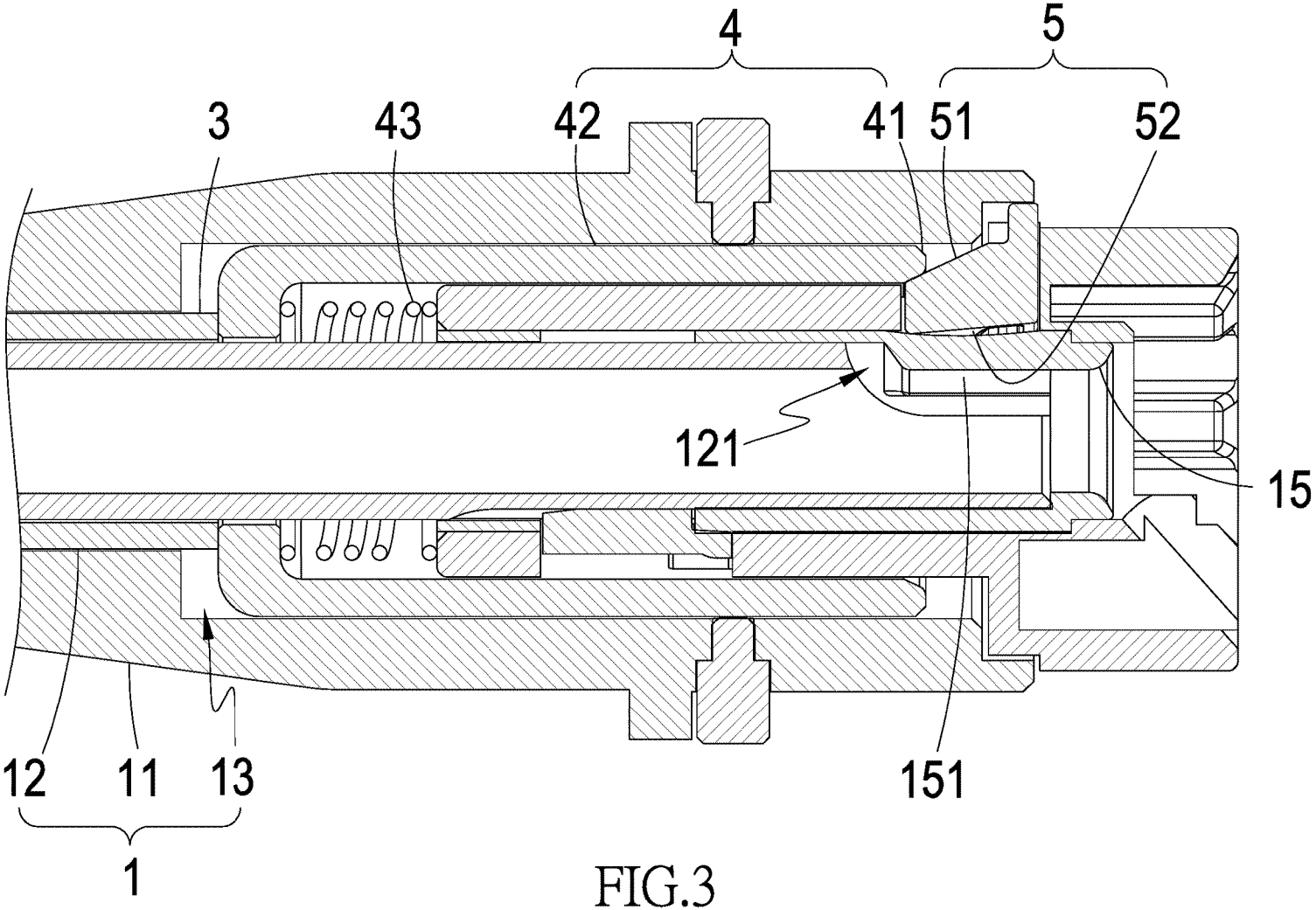
FIG. 3 is a cross-sectional view showing a rear end part of a gun barrel of the present invention.
Figure 4:
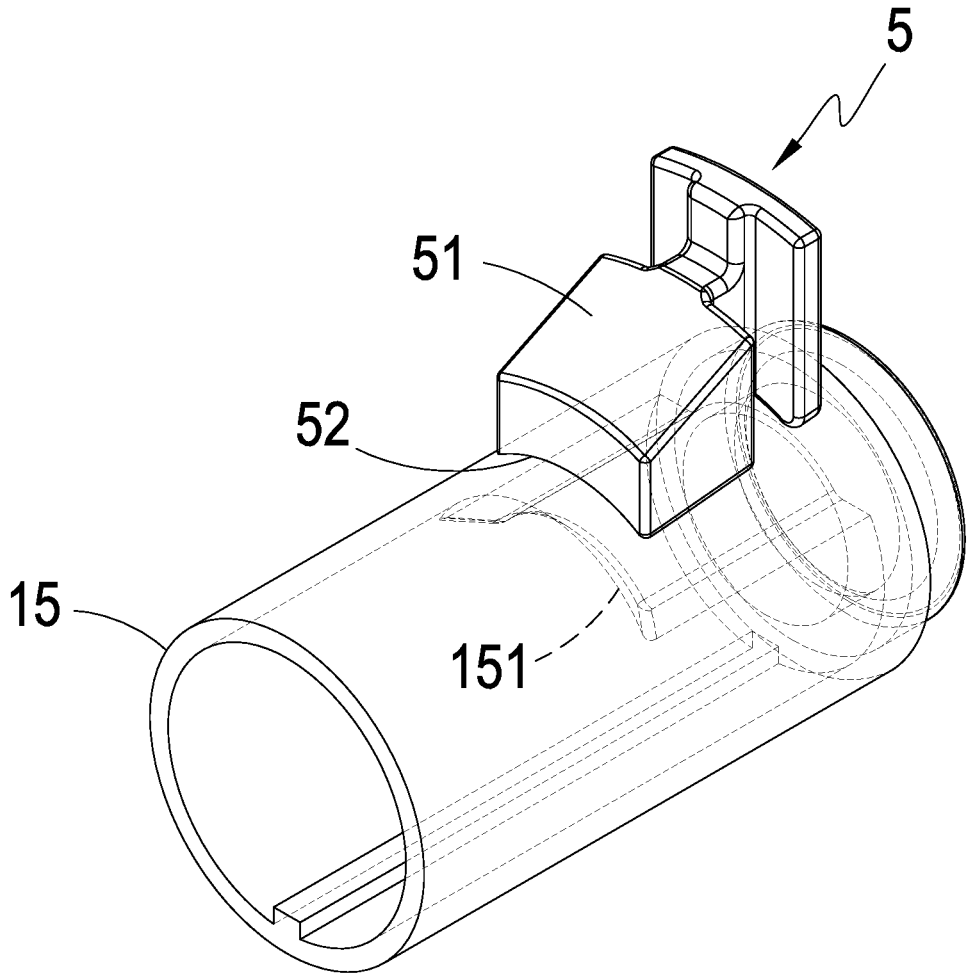
FIG. 4 is a schematic view illustrating the structure of a press-down member and a flexible tube.
Figure 9:
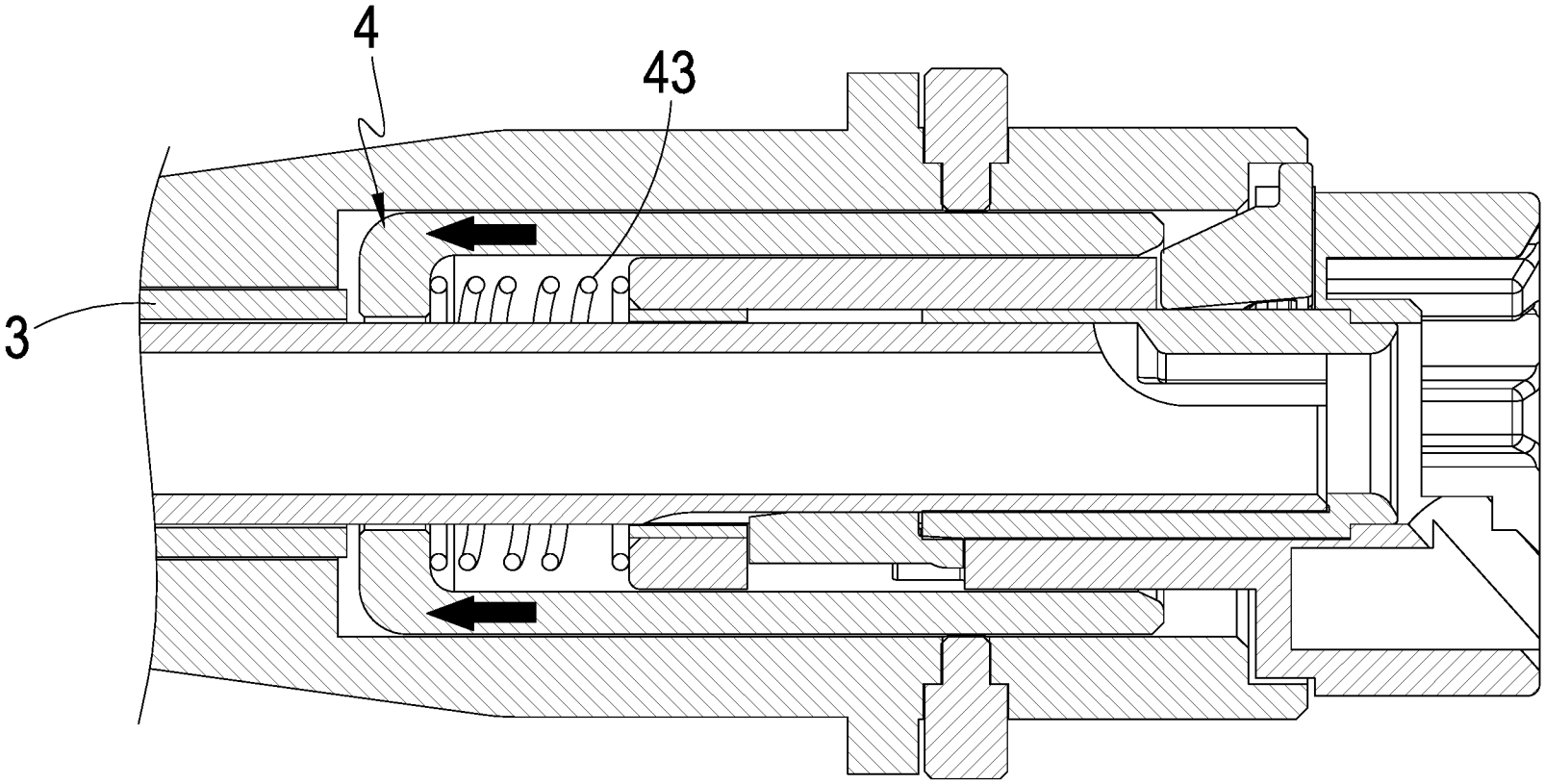
FIG. 9 is another schematic view demonstrating transmission conducted with the preferred embodiment of the present invention.

When the user operates or uses the adjustment assembly 2 to cause back spinning, in additional to a frontward movement of the internal adjustment member 22, as shown in FIG. 9, the transmission sleeve 4 is also pushed or biased by the returning element 43 in a direction toward the connection tube 3 to keep the connection tube 3 in a condition of being in contact engagement with the internal adjustment member 22 (as shown in FIG. 2), so that the adjustment assembly 2 could be effectively operated by the user for any desired movement.

Figure 10:
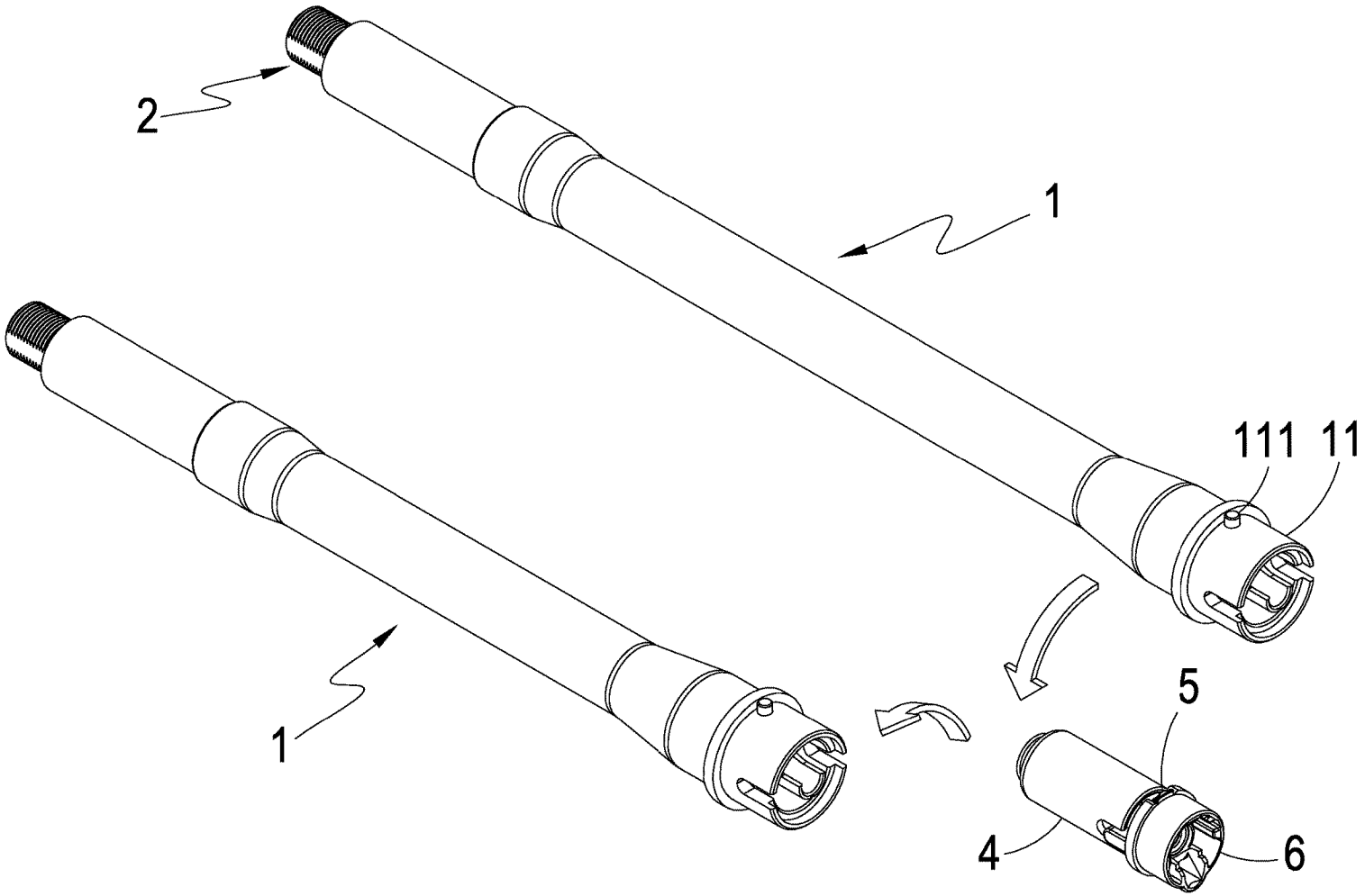
FIG. 10 is a schematic view demonstrating gun barrel replacement conducted with the preferred embodiment of the present invention.

As shown in FIG. 10, for replacement of the gun barrel 1, since the transmission sleeve 4 and the press-down member 5 are fixed by the fixing assembly 6 in an easy and simple manner, it only needs to release a fixing part 111 of the external barrel member 11 to withdraw the gun barrel 1. As such, the adjustment assembly 2, the gun barrel 1, and the connection tube 3 could be withdrawn and separated from the fixing assembly 6, the transmission sleeve 4, and the press-down member 5 so that replacement of the gun barrel 1 could be carried out easily.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A trajectory adjustment mechanism, which is adapted to mount in a gun barrel of a gun, comprising:

an adjustment assembly arranged at a front end of the gun barrel;

a connection tube arranged in the gun barrel and in abutting engagement with the adjustment assembly to be driven by the adjustment assembly to move;

a plurality of thread sections formed on the adjustment assembly and in threading engagement with the gun barrel for fine adjustment of the adjustment assembly;

at least one transmission sleeve arranged at one end of the connection tube that is distant from the adjustment assembly; and a press-down member arranged at one side of the transmission sleeve and in abutting engagement with the transmission sleeve to be pressed inwardly of the gun barrel.

2. The trajectory adjustment mechanism according to claim 1, wherein the adjustment assembly comprises an internal adjustment member for pushing and moving the connection tube and an external adjustment member screwed between the gun barrel and the internal adjustment member.

3. The trajectory adjustment mechanism according to claim 2, wherein the external adjustment member has an inside wall that comprises a plurality of internal thread sections formed thereon to correspond to and mate the thread sections.

4. The trajectory adjustment mechanism according to claim 2, wherein the internal adjustment member has an outside circumferential wall that comprises a plurality of positioning grooves formed therein and the external adjustment member comprises at least one positioning projection provided thereon, at least one elastic element being arranged to have two ends thereof supported on and coupled to the positioning projection and an inside wall of the gun barrel.

5. The trajectory adjustment mechanism according to claim 1 further comprising a fixing assembly that is arranged at a rear end of the gun barrel to fix the transmission sleeve and the press-down member such that the gun barrel, the adjustment assembly, and the connection tube are adapted to detachably couple to the gun.

6. The trajectory adjustment mechanism according to claim 1, wherein the gun barrel comprises an external barrel member, an internal barrel member arranged inside the external barrel member adapted to receive a BB bullet to move therein, and at least one movement space formed between the external barrel member and the internal barrel member.

7. The trajectory adjustment mechanism according to claim 6, wherein the transmission sleeve comprises at least one abutting section set in abutting engagement with the press-down member and at least one constraint section that encloses the internal barrel member and is in contact engagement with an inside wall of the external barrel member to provide a stable horizontal movement of the transmission sleeve.

8. The trajectory adjustment mechanism according to claim 6, wherein the movement space receives a returning element arranged therein and coupled to the transmission sleeve so as to cause the transmission sleeve to move in a direction toward the connection tube.

9. The trajectory adjustment mechanism according to claim 6, wherein the internal barrel member comprises a notch section formed therein, a flexible tube being disposed on the internal barrel member, the flexible tube comprising a second curved surface section formed on one side thereof corresponding to the notch section to be abutted on by the press-down member to provide abutting engagement, through surface contact, with a BB bullet passing therethrough.

10. The trajectory adjustment mechanism according to claim 1, wherein the press-down member comprises a slope section formed thereon at one side thereof that is adjacent to the transmission sleeve to change an inclination angle of the press-down member with variation of a position of the abutting engagement thereof with the transmission sleeve, the press-down member being provided with a first curved surface section on one side thereof that is opposite to the slope section and adapted to provide abutting engagement, through surface contact, with a BB bullet passing there-through.

* * * * *